United States Patent [19]

Baghuis

[11] Patent Number: 4,599,057

[45] Date of Patent: Jul. 8, 1986

[54] ROTARY BLADE MACHINE WITH BLADE END SEALING

[75] Inventor: Ludovicus H. Baghuis, AA Den Bosch, Netherlands

[73] Assignee: Van Mullekom Innovation B.V., Netherlands

[21] Appl. No.: 673,744

[22] PCT Filed: Feb. 23, 1984

[86] PCT No.: PCT/NL84/00007

§ 371 Date: Oct. 17, 1984

§ 102(e) Date: Oct. 17, 1984

[87] PCT Pub. No.: WO84/03330

PCT Pub. Date: Aug. 30, 1984

[51] Int. Cl.[4] ..... F01C 1/00; F01C 19/00

[52] U.S. Cl. ..... 418/146; 418/260; 418/268

[58] Field of Search ..... 418/145, 146, 260, 261, 418/268

[56] References Cited

U.S. PATENT DOCUMENTS

| | | | |
|---|---|---|---|
| 134,123 | 12/1872 | Bennett | 418/260 |
| 990,163 | 4/1911 | Von Pittler | 418/260 |
| 3,102,494 | 9/1963 | Adams | 418/268 |
| 3,567,347 | 3/1971 | Scott | 418/146 |

FOREIGN PATENT DOCUMENTS

| | | | |
|---|---|---|---|
| 562324 | 10/1932 | Fed. Rep. of Germany | 418/146 |
| 319467 | 9/1929 | United Kingdom | 418/146 |

*Primary Examiner*—John J. Vrablik

*Attorney, Agent, or Firm*—John P. Snyder

[57] ABSTRACT

A rotary blade machine, for example, a blades pump mainly comprising a rotor having outwardly opening, axial slots, a blade slidably arranged in each slot and a stator surrounding the rotor with the blades and having inlet and outlet ports, wherein in an axial sense the blades project at both ends beyond the rotor into a chamber formed by a re-entrant side wall part of the stator, said chamber accommodating a shut-off body associated with each blade, in order to prevent leakage along the blades, particularly along their side edges.

23 Claims, 10 Drawing Figures

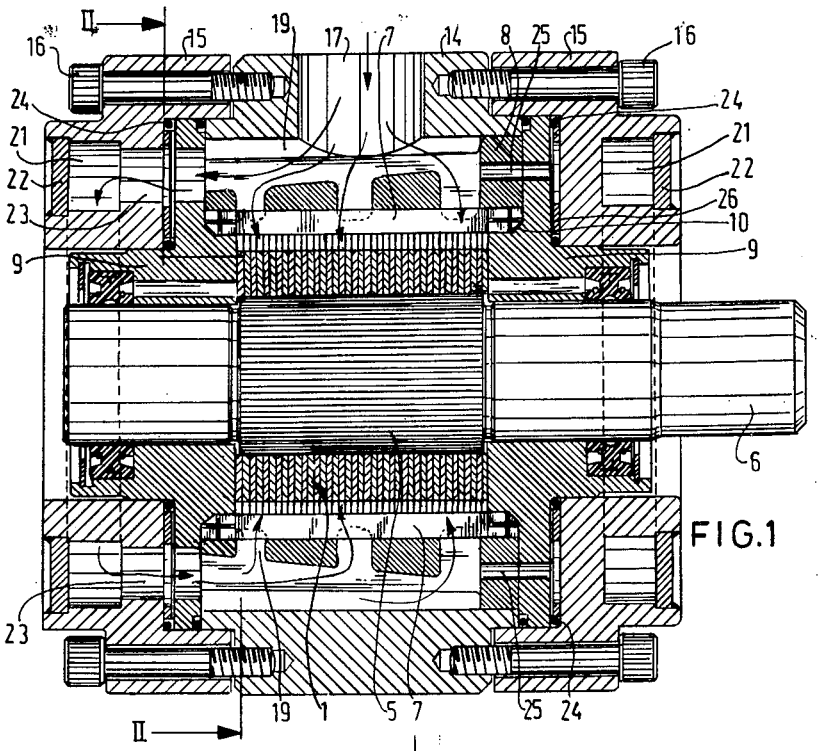
FIG.1
FIG. 2
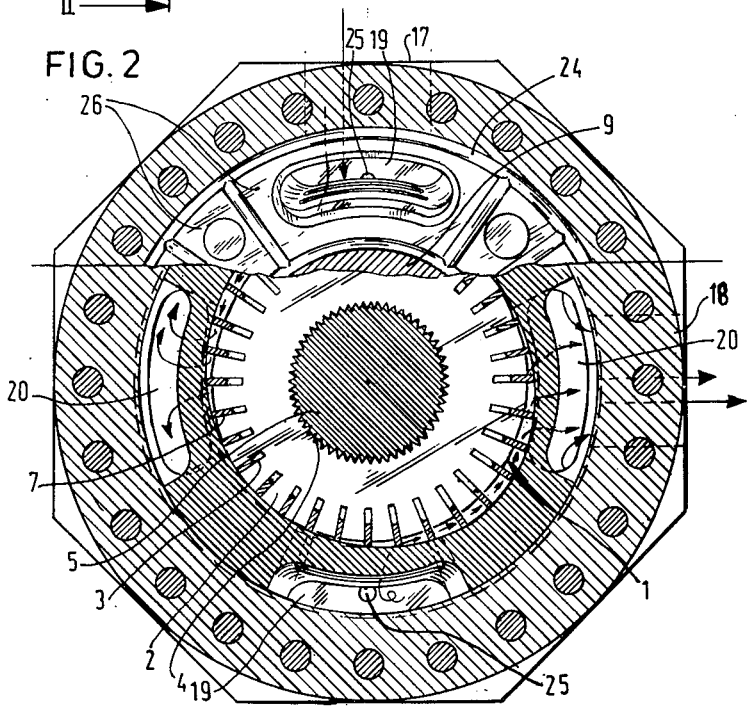

FIG. 3
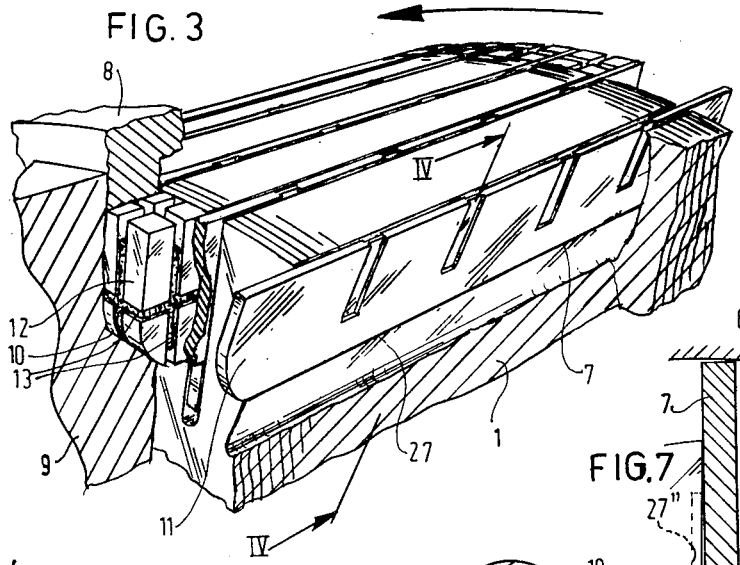
FIG. 7
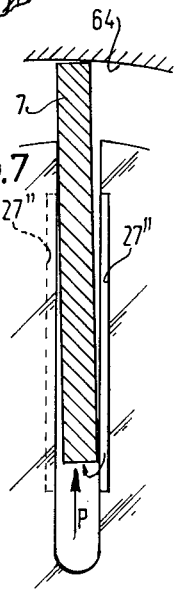
FIG. 4
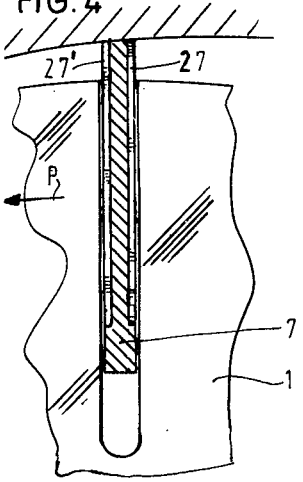
FIG. 5
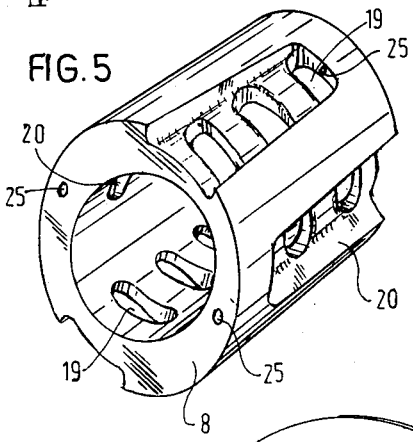
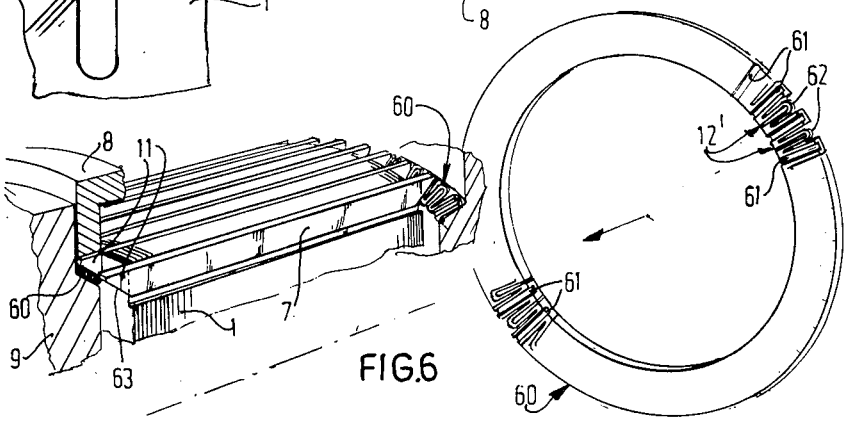
FIG. 6

FIG. 8
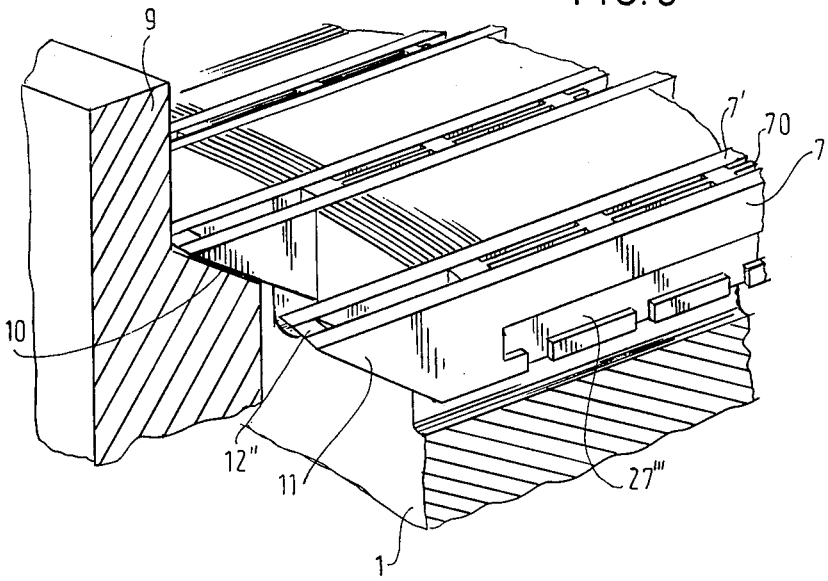
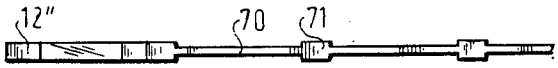
FIG. 9b
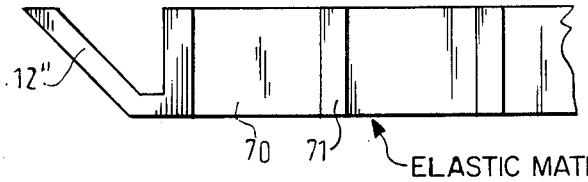
FIG. 9a

ROTARY BLADE MACHINE WITH BLADE END SEALING

The invention relates to a rotary blade machine, for example, a blades pump mainly comprising a rotor having outwardly opening axial slots and blades each slidably arranged in each slot and a stator surrounding the rotor with the blades and having inlet and outlet ports.

The invention has for its object to improve the seal across the moving blades in a rotary blade machine of the kind set forth in the preamble. In the successive compartments between two blades different pressures will prevail so that leakage will occur along the blades, in particular along the sides thereof.

The rotary blade machine embodying the invention is distinguished in that in an axial sense the blades project at both ends beyond the rotor into a chamber formed by a re-entrant sidewall part of the stator, said chamber accomodating a shut-off body associated with each blade.

By this shut-off body any leakage along the side and top edges of the blades is avoided since this shut-off body closes the gap between each blade and the stator.

In one embodiment the shut-off body is constructed in the form of a filling body comprising eight wear-resistant blocks interconnected by a flexible intermediate layer. The flexible intermediate layer serves as a spring element to urge the blocks against the slot.

One of the additional advantages of the filling bodies in this embodiment is that the blades furthest slipped out of the rotor remain in the desired position, that is to say, they will not tilt.

This is furthered by urging the inwardly slipped blades against one side of the unavoidably larger slot in the rotor, which can be performed in accordance with the invention by providing relief grooves at each blade at least on the low-pressure side.

According to a further embodiment the shut-off body grips around the side edge of the blade, whilst the bodies are resiliently interconnected so that a single ring is obtained, which simplifies mounting and manufacture.

According to a further aspect the shut-off body is connected with a strip extending at the side of the blade.

In order to facilitate mounting of the rotor with the blades in the stator, the wall of the chamber in the stator facing the rotational centre as well as the edge of the projecting blade end have a locating rim so that in addition the leakage gap is reduced.

In order to minimize drop of pressure across the blades a great number of blades are distributed in known manner along the circumference of the rotor. This means that a large number of grooves have to be made in the rotor, which involves problems in the manufacture of solid rotor bodies.

In order to eliminate this drawback the invention proposes to build up the rotor body by means of plates, each plate being punched in the desired shape with slots in a star-shaped array from a basic plate. By providing slots of relatively different widths in the plates the relief grooves can be formed in the rotor.

In order to ensure small tolerances of the stator dimensions the stator embodying the invention is formed by an outer ring having inlet and outlet ports and two bearing plates comprising the chamber. Moreover the materials of the various component parts can now be appropriately chosen. These stator parts are enclosed in a housing.

Such a construction is particularly suitable for establishing a communication between two diametrically opposite inlet and outlet channels respectively in the stator ring by means of two distribution channels arranged in the housing so that a uniform load on the rotary shaft of the machine is ensured. This implies that the filling bodies between the blades have a long lifetime owing to the minor deformations.

The invention will be described more fully with reference to an embodiment.

The drawing shows in

FIG. 1 an axial longitudinal sectional view of the machine embodying the invention, FIG. 2 a sectional view taken on the line II—II in FIG. 1, FIG. 3 a perspective view of part of the rotor in which blades are arranged and of part of the stator, FIG. 4 a cross-sectional view of a blade arranged in a slot of the rotor, FIG. 5 a perspective view of the stator ring, FIG. 6 an elevational view like FIG. 3 of a second embodiment, FIG. 7 a cross-sectional view of a blade arranged in a slot in the embodiment shown in FIG. 6, FIG. 8 a perspective view like FIG. 3 of a third embodiment, FIGS. 9*a* and 9*b* a side elevation and a plan view respectively of a shut-off strip used in said third embodiment.

The rotary blade machine shown in the Figures comprises a rotor 1 formed by a plurality of annular plates 2 (see FIG. 2) each having a crown of slots 3 at the outer circumference. Along the inner circumference a toothing 4 is arranged to co-operate with a spline shaft part 5 of the rotary shaft 6.

The slots 3 in the plates 2 constitute in the mounted state of the rotor axially extending slots, each of which receives a radially slidable blade 7.

Around the rotor with the blades 7 is arranged a stator comprising a ring 8 having two head plates 9, which form at the same time a bearing ring for the shaft 6.

The inwardly directed sidewalls of the plates 9 are inwardly bent over at 10 and the blades 7 are provided at both ends with protruding parts 11. The outer edge of the protruding part 11 is complementary to the cross-sectional shape of the sidewall of part 9.

In the space between two blades 7, the outer plates of the rotor 1, the re-entrant sidewalls of the head plates 9 and the inner wall of the ring 8 a filling body 12 is arranged as a shut-off member. (see FIG. 3). This filling body 12 comprises eight wear-resistant blocks of suitable shape, between which a layer of flexible material is sandwiched. This intermediate layer 13 ensures a constant pressure of the blocks on the slots between the relatively moving parts.

Moreover deformation of the filling body 12 is possible during the inward and outward movements of the blades with respect to the rotor, during which movements the distance between the blades increases and decreases respectively.

The rotor and the stator are arranged in a housing comprising a central ring 14 and two head plates 15 fastened to one another by bolts 16.

The central ring 14 has an inlet port 17 (see FIG. 1) and an outlet port 18 off-set through 90° indicated in FIG. 2 by broken lines.

The inlet port 17 and the outlet port 18 communicate with the inlet port 19 in the stator ring 8 and the outlet ports 20 thereof respectively (see FIG. 5).

In the stator ring 8 the outlet and inlet ports are respectively located diametrically opposite one another and they communicate with one another by an annular communication channel 21 in each head plate 15.

This channel is milled in annular form in the head plate and subsequently closed by a sealing plate 22 (see FIG. 1). Through registering openings 23, which are also provided in the side plates of the stator, the channels 21 communicate with the ports in the stator ring 8.

A sealing ring 24, which bounds sector-shaped regions around the inlet and outlet ports is arranged between each plate 9 and the neighbouring head plate 15. Each sector communicates with a port through the passage 23 or the channel 25. The purpose is to transfer the pressure at the outlet port to the outer side of the plate 9 so that owing to the larger outer surface said pressure has an inwardly directed pressure resultant so that the gap between the plate 9 and the rotor with blades is automatically minimized. The size of the intermediate sectors between the port sectors of the seal 24 depends on the desired value of the pressure resultant. These sectors can communicate through a bore 25 in the plate 9 with a zero line (not shown). The sectors between the seal are filled out by filling plates 26, which prevent deformation of the seal. The edge of the protruding end of each blade 7 as well as the re-entrant wall of the chamber in the side plate are bevelled or rounded off (see FIG. 1 or 3, respectively), which provides a pilot edge to facilitate mounting. In order to minimize the fluid to be expelled from the space in the rotor below the blade 7, the blades are constructed as thin as possible.

Tilting of the blades in the relatively wide slots of the rotor 1 is avoided by providing relief grooves 27 on the low-pressure side of the blade 7, which is further described with reference to FIG. 4.

In the case of a pump the blade will move in the direction of the arrow P so that a high pressure is created on the front side of the blade 7. The grooves 27 on the rear side ensure uniform evacuation of fluid out of the slot between the low-pressure side and the adjacent side wall of the groove in the rotor 1. The blade 7 will therefore smoothly engage the rear wall of the slot in the rotor 1, whilst the straight position is imparted through the filling bodies 12 to the vanes lying further outwards so that tilting is avoided and hence a quiet run is obtained.

Since in this case the machine can be used in the direction of rotation opposite the arrow P1, the blades are also provided with grooves 27' on the opposite side.

Referring now to FIGS. 6 and 7, a modified form of the invention is illustrated including a pair of continuous flexible ring members 60 for sealing opposite ends of the blades. Each ring member is of serpentine configuration defining a plurality of shut off bodies 12' each of which has a slot 61 therein for snugly receiving one end of a blade. Adjacent bodies 12' are interconnected by integral portions 62 which have a generally U-shaped configuration so as to form spring bodies allowing adjacent bodies 12' to move relative to one another. Ring members 60 may be shaped into the desired form for example by etching. This has the advantage that each body 12' has a great freedom of movement and can thus match any desired position. This results inter alia in the use of conventionally shaped blades 7, which may be slightly tilted in the slot (see FIG. 7), which promotes a satisfactory seal at the upper rim 64 of the slot as well as a correct hydraulic pressure P on the lower side of the blade. The supply of fluid to the slot space below the blade is ensured through the grooves 27'' in the rotor body. The grooves 27'' are formed in this case by a locally broader incision in a rotor plate than in the adjacent plates. It should be noted that the pilot rim 63 is straight.

Referring to FIGS. 8 and 9 the shut-off body 12'' is connected on the underside with a strip 70 extending along the blade 7. In the embodiment shown the second blade 7' is disposed on the other side of the strip. The strip is provided with ridges 71 so that channels are formed between the strip and the blade to enable fluid transport during the inward and outward slide of the blade system into and out of the slot respectively. Also in this embodiment the blades are provided with the relief grooves 27.

The invention is not limited to the embodiments described above; in particular the filling pieces 12 may have a different shape. In specific structures a filling piece of flexible, wear-resistant material, for example, a synthetic resin may be conceived as a single cast or spray-cast unit.

The ends of the blades 7 may have any desired form, whilst the blades may occupy another position than the radial one in the rotor, that is, they may be disposed such that they are inclined relative to the radial direction either forwardly or rearwardly with respect to the direction of rotation of the rotor.

The machine shown here as a pump may as well be a motor.

I claim:

1. In a rotary blade machine for displacing fluids and comprising the combination of a rotor, a plurality of blades carried by the rotor and a stator enclosing the rotor, the improvement wherein said rotor is of a predetermined axial length presenting an outer surface provided with a circumferentially spaced series of slots each extending throughout the axial extent of said rotor, said blades being slidably disposed in said slots and each presenting an outer edge having a length greater than the axial length of said rotor so that each blade presents opposite ends of its outer edge which project beyond the respective opposite ends of the rotor, said stator having an inner surface surrounding said rotor and having a width extending axially relative to said rotor commensurate with the length of said outer edges of said blades and sealingly engaging such outer edges throughout the lengths thereof and said inner surface being contoured relative to said outer surface of said rotor to cause said blades to reciprocate within said slots as the rotor is rotated within said stator, said stator including wall means at each axial end of said rotor for defining a chamber at each axial end of said rotor of circumferentially uniform cross-section substantially conforming to and closely accomodating the ends of all the blades projecting beyond the corresponding axial end of said rotor, and means for preventing leakage of fluid along said opposite ends of the blades within said chambers.

2. In a rotary blade machine as defined in claim 1 wherein said means comprises a plurality of resilient assemblies filling said cross-sections of said chambers between said blades.

3. In a rotary blade machine as defined in claim 2 wherein each resilient assembly comprises a set of wear resistant blocks and resilient means separating said blocks.

4. In a rotary blade machine as defined in claim 1 wherein said means comprises a flexible ring in each chamber engaging each corresponding wall means and connected with the corresponding ends of the blades.

5. In a rotary blade machine as defined in claim 4 wherein each ring is of serpentine configuration having a circumferentially spaced series of slotted members receiving respective ends of the blades and generally U-shaped portions joining said members.

6. In a rotary blade machine as defined in claim 1 wherein said means comprises a plurality of resilient members carried in the slots of said rotor and each engaging one side of a corresponding blade adjacent a corresponding wall means.

7. In a rotary blade machine as defined in claim 6 wherein each of said resilient members includes a narrow portion projecting into a respective chamber and engaging said one side of a blade along a corresponding wall means.

8. In a rotary blade machine as defined in claim 6 wherein a pair of spaced blades are disposed within each of said slots, one of said resilient members being disposed between each of such pair of blades and engaging facing surfaces of such pair of blades.

9. In a rotary blade machine comprising the combination of a rotor, a plurality of blades carried by the rotor and a stator enclosing the rotor, the improvement wherein said rotor is of a predetermined axial length presenting an outer surface provided with a circumferentially spaced series of slots each extending throughout the axial extent of said rotor, said blades being slidably disposed in said slots and each presenting an outer edge having a length greater than the axial length of said rotor so that each blade presents opposite ends of its outer edge which project beyond the respective opposite ends of the rotor, the opposite ends of each blade having an underside edge extending from a respective end of its outer edge to the respective axial end of the rotor to define an area characteristic of each opposite end of each blade, said stator having an inner surface of a width commensurate with the length of said outer edges of said blades and sealingly engaging such outer edges throughout the lengths thereof and said inner surface being contoured relative to said cylindrical outer surface of said rotor to cause said blades to reciprocate within said slots as the rotor is rotated within said stator, said stator including wall means at each axial end of said rotor extending from a respective end of said inner surface axially inwardly to a position disposed radially inwardly of said outer surface of said rotor in closely spaced relation to said undersides of respective blade ends for defining a chamber of circumferentially uniform cross-section substantially equal in area to said area of the blade ends and closely accomodating the ends of all the blades projecting beyond the corresponding axial end of said rotor whereby said ends of the blades sweep the respective chambers as the rotor is rotated, and means for preventing leakage along said opposite ends of the blades within said chambers.

10. In a rotary blade machine as defined in claim 9 wherein said means comprises a plurality of resilient assemblies filling said cross-sections of said chambers between said blades.

11. In a rotary blade machine as defined in claim 9 wherein said means comprises a flexible ring in each chamber engaging each corresponding wall means and connected with the corresponding ends of the blades.

12. In a rotary blade machine as defined in claim 9 wherein said means comprises a plurality of resilient members carried in the slots of said rotor and each engaging one side of a corresponding blade.

13. In a rotary blade machine as defined in claim 12 wherein a pair of spaced blades are disposed within each of said slots, one of said resilient members being disposed between each such pair of blades and engaging facing surfaces of such pair of blades.

14. A rotary blade machine for displacing fluids comprising the combination of a rotor having a a series of generally radial slots each extending from one end of the rotor to the other end of the rotor and circumferentially spaced from each other;

a plurality of blades each having a straight outer edge and each blade being slidably disposed in a respective slot, each blade having a length greater than the axial length of the rotor so that each blade presents opposite ends projecting beyond the respective opposite axial ends of the rotor;

a stator having an inner surface surrounding said rotor which engages said straight outer edges of the blades thoughout their lengths and having a circumferential contour which causes said blades to reciprocate radially within said slots as the rotor is rotated within said stator; and means engaging respective opposite ends of the blades for preventing leakage along said opposite ends of the blades.

15. A rotary blade machine as defined in claim 14 wherein said means comprises separate resilient fillers disposed between facing opposite sides of adjacent opposite ends of the blades.

16. A rotary blade machine as defined in claim 14 wherein said means comprises a resilient generally annular ring receiving corresponding opposite ends of said blades.

17. A rotary blade machine as defined in claim 14 wherein said means comprises a strip received in each slot and having opposite resilient end portions engaging the side surfaces of the opposite ends of its associated blade.

18. A rotary blade machine as defined in claim 17 wherein a pair of spaced blades are disposed within each of said slots, one of said strips being disposed between each such pair of blades and engaging facing surfaces of such pair of blades.

19. A rotary blade machine comprising the combination of a rotor having a predetemined axial length and a series of generally radial slots extending from one axial end to the other and circumferentially spaced from each other, a blade slidably disposed in each slot and each blade having a length greater than said predetermined axial length of the rotor so that each blade presents opposite ends projecting beyond the respective opposite axial ends of the rotor and each blade having a straight outer edge, a stator having an inner surface surrounding said rotor and having a contour which engages said straight outer edges of said blades and causes said blades to reciprocate radially within said slots as the rotor is rotated within said stator, said inner surface extending axially relative to said rotor beyond the opposite axial ends thereof so that said inner surface is commensurate with the lengths of said blades to engage them throughout the lengths of said flat outer edges thereof, side wall means extending from closely adjacent said rotor to said inner surface for defining a chamber at each side of said rotor through which the respective opposite ends of said blades sweep as the rotor is rotated, and means for preventing leakage along said opposite ends of the blades within the respective chambers.

20. A rotary blade machine as defined in claim 19 wherein said means comprises separate resilient fillers disposed within said chambers between facing opposite sides of opposite ends of adjacent blades.

21. A rotary blade machine as defined in claim 19 wherein said means comprises an annular ring having flexible webs defining slots receiving corresonding opposite ends of said blades.

22. A rotary blade machine as defined in claim 19 wherein said means comprises a strip received in each slot and having opposite resilient end portions engaging the side surfaces of the opposite ends of its associated blade.

23. A rotary blade machine as defined in claim 22 wherein a pair of spaced blades are disposed within each of said slots, one of said strips being disposed between each such pair of blades and engaging facing surfaces of such pair of blades.

* * * * *